US006695668B2

(12) United States Patent
Donahue et al.

(10) Patent No.: US 6,695,668 B2
(45) Date of Patent: Feb. 24, 2004

(54) TOY VEHICLE AND METHOD OF CONTROLLING A TOY VEHICLE FROM A PRINTED TRACK

(76) Inventors: Kevin Gerard Donahue, 26 Tahattawan Rd., Littleton, MA (US) 01460; Jack I. Raffel, 35 Moon Hill Rd., Lexington, MA (US) 02421; Robert John Caldicott, 16 Hampton Rd., Natick, MA (US) 01760

( * ) Notice: Subject to any disclaimer, the term of this patent is extended or adjusted under 35 U.S.C. 154(b) by 0 days.

(21) Appl. No.: 10/058,674

(22) Filed: Jan. 29, 2002

(65) Prior Publication Data

US 2002/0102910 A1 Aug. 1, 2002

Related U.S. Application Data

(60) Provisional application No. 60/264,783, filed on Jan. 29, 2001.

(51) Int. Cl.[7] ..... A63H 30/00

(52) U.S. Cl. ..... 446/175; 446/485; 446/444; 446/410; 446/409; 446/465

(58) Field of Search ..... 446/485, 175, 446/444, 410, 409, 465, 460; 434/169

(56) References Cited

U.S. PATENT DOCUMENTS

| | | | | | |
|---|---|---|---|---|---|
| 3,130,803 | A | * | 4/1964 | Wiggins | 446/175 |
| 3,849,931 | A | | 11/1974 | Gulley, Jr. | |
| 4,086,724 | A | | 5/1978 | McCaslin | |
| 4,466,801 | A | * | 8/1984 | Dittakavi et al. | 434/169 |
| 4,505,682 | A | * | 3/1985 | Thompson | 434/169 |
| 4,566,032 | A | * | 1/1986 | Hirooka et al. | 358/103 |
| 4,658,928 | A | * | 4/1987 | Seo | 446/454 |
| 4,925,424 | A | * | 5/1990 | Takahashi | 446/175 |
| 4,990,117 | A | * | 2/1991 | Yonezawa | 446/129 |
| 5,297,484 | A | * | 3/1994 | Piserchia et al. | 446/446 |
| 5,415,553 | A | * | 5/1995 | Szmidla | 434/309 |
| 5,630,743 | A | | 5/1997 | Shi | |
| 5,716,275 | A | * | 2/1998 | Wada et al. | 463/62 |
| 5,816,886 | A | * | 10/1998 | Cusolito | 446/444 |
| 5,908,345 | A | * | 6/1999 | Choi | 446/436 |
| 6,059,657 | A | * | 5/2000 | Oh et al. | 446/444 |
| 6,168,494 | B1 | * | 1/2001 | Engel et al. | 446/484 |
| 6,482,064 | B1 | * | 11/2002 | Lund | 446/175 |

FOREIGN PATENT DOCUMENTS

| | | | | |
|---|---|---|---|---|
| DE | 3444426 A1 | * | 6/1986 | A63H/19/00 |
| JP | 09044246 A | * | 2/1997 | A63H/30/00 |
| JP | 2001-113055 A | * | 4/2001 | A63H/5/00 |

* cited by examiner

*Primary Examiner*—Derris I. Banks
*Assistant Examiner*—Urszula M Cegielnik
(74) *Attorney, Agent, or Firm*—Michelle Bugbee

(57) ABSTRACT

This invention relates to an inexpensive toy track vehicle with optical sensors for use on a printed track, and a method for controlling the vehicle on a printed track. Specifically, this invention comprises a toy track vehicle having optical sensors, which operates on a printed track

13 Claims, 9 Drawing Sheets

TOY VEHICLE AND METHOD OF CONTROLLING A TOY VEHICLE FROM A PRINTED TRACK

CROSS REFERENCE TO RELATED APPLICATIONS

This application claims the benefit of Provisional Application No. 60/264,783, filed Jan. 29, 2001.

FIELD OF THE INVENTION

The present invention is directed to a toy track vehicle with optical sensors, and a method for controlling the vehicle on a printed track. Specifically, this invention comprises a toy track vehicle having optical sensors

BACKGROUND OF THE INVENTION

Toy track vehicles have been a mainstay of children's toy chests for the past century. Such tracked devices have varied widely. Simple track vehicles include mechanically guided, electrically driven trains such as the trains manufactured by LIONEL and other similar toy manufacturing companies. There are also more sophisticated devices that operate via remote or voice control and have bells and whistles controlled by sensors embedded in the track More recently, LEGO introduced a form of trackless vehicle having a built-in programmer that communicates with a personal computer (PC) using an infrared link. This trackless vehicle also has touch and optical sensors allowing the vehicle to execute a series of preprogrammed, motor driven motions that can be conditionally changed by sensor inputs.

Toy vehicles found in the prior art include U.S. Pat. No 3,849,931 to Gulley, Jr. that describes a method of guiding a toy vehicle with a light beam. U.S. Pat. No. 4,086,724 to McCaslin that describes a toy vehicle with a steering mechanism that is responsive to acoustic signals, and U.S. Pat. No. 5,630,743 to Shi that describes the use of a specific type of CdS photoresistors for sensing reflected light from a track. The steering of the Shi vehicle is accomplished using a complex mechanical arrangement comprising a set of worm gears that drive the vertical axle, which in turn causes the wheel assembly to turn, thereby turning the car. There is no provision for illumination; this vehicle appears to depend on ambient light only.

What is needed in the art is an inexpensive, simple toy vehicle for use on a printed track that is optically controlled, and a method for controlling the toy vehicle on a printed track. This method needs to be an inexpensive method for guiding a vehicle without the need for mechanical constraints.

SUMMARY OF INVENTION

Accordingly, the present invention overcomes the disadvantages of the prior art by providing an inexpensive, simple toy track vehicle that is optically controlled for use on a printed track, and a method for controlling the toy vehicle on a printed track.

In a first aspect, the present invention provides a toy track vehicle having at least one optical sensor that is used on a printed track. The toy track vehicle additionally has at least two wheels driven by at least one motor and a light source. The light source may be ambient light, light from an LED, or other light known in the art. The toy track vehicle has a smaller turning radius than can be achieved with rails or other tracking devices.

In a further aspect, the present invention relates to a method for guiding a toy track vehicle on a printed track. The toy track vehicle has wheels and also has at least one optical sensor for sensing track position. The track is printed on paper and is preferably produced by a computer program. The track further includes control symbols that keep the vehicle on track. The control symbols can also initiate other actions, such as reversing direction, accelerating, stopping, making sounds and turning on lights. The computer program that designs and prints the track can produce an essentially unlimited number of variations of track shape and control symbol locations so as to provide an ever changing sequence by simply modifying the layout on the computer and printing out a new control track. Alternatively, the track can be drawn by hand by the user rather than printed on a computer printer and preprinted or hand drawn control symbols can be placed by hand along the track.

In a further aspect, the present invention provides a method for controlling a toy track vehicle on a printed track and eliminates the slow and limited process of mechanically modifying interconnecting track segments. The track is infinitely changeable by simply modifying the program on a personal computer to produce a new track shape and printing out the track on ordinary paper. Alternatively, the user can draw the track by hand on paper or other contrasting surface and draw new tracks as desired.

In another embodiment, the track surface may be folded for compact storage. Additionally, this method provides a form of tracking that allows the toy vehicle to have a much smaller turning radius than can be achieved with rails or other mechanical tracking devices so as to allow more varied track patterns.

In a further embodiment, the present invention provides a method for placing recognizable symbols at points along the track to initiate actions such as reversing, stopping, accelerating and producing sounds and turning on lights.

These and other objects and features of the invention will be apparent from the detailed description set forth below.

BRIEF DESCRIPTION OF DRAWINGS

The present invention will become more fully understood from the detailed description and the accompanying drawings. The description and drawings are given by way of illustration only, and thus do not limit the present invention.

DETAILED DESCRIPTION OF INVENTION

Figure 1A:
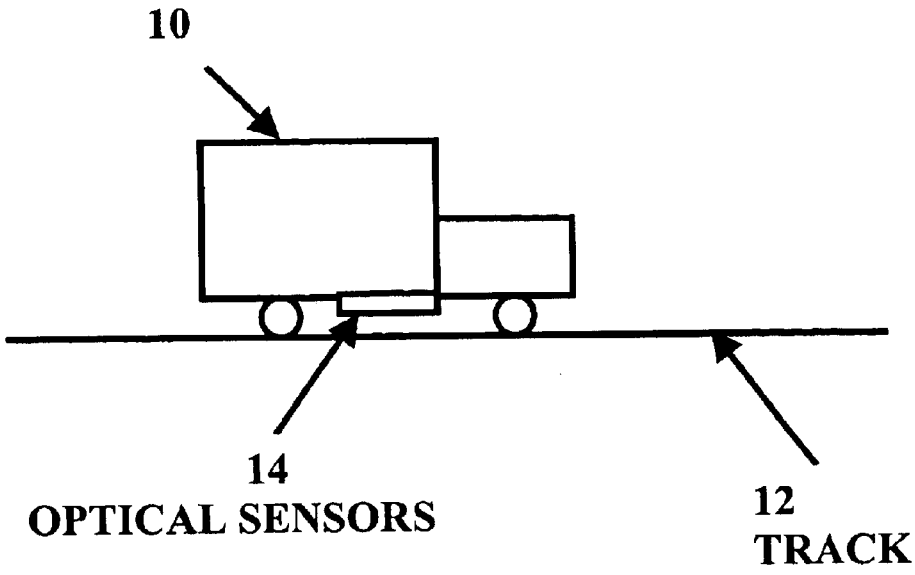
FIG. 1A is a side view of a wheeled toy vehicle positioned above a printed track with the optical sensors facing the surface or track on which it moves.

FIG. 1A is a preferred embodiment of the present invention. A toy car 10 is shown in side view in position above a printed track 12 with optical sensors 14 facing down so as to detect reflected light from the track 12 imprinted on the paper surface. In one embodiment, the sensors 14 are positioned with respect to the black track 12 so that no signal is picked up when the vehicle is on track. If the track begins to curve as the vehicle proceeds forward, the sensor 14, or one of the sensors 14 will begin to pick up a white signal. The white signal will then either cause the steering wheel to turn so as to remove the white signal, or alternatively, if separate motors are supplied to each wheel, it can cause the associated wheel to increase its speed to turn the vehicle to keep it on the track 12.

Figure 1B:
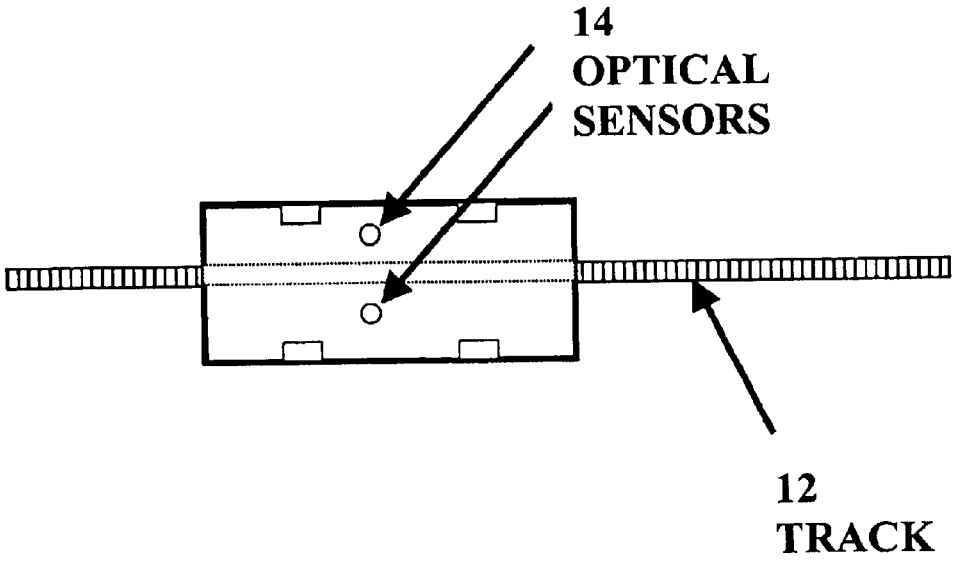
FIG. 1B is a top view of the vehicle showing a pair of phototransistors as the sensors.

The optical sensor(s) 14 can be in the form of a multipixel CCD or CMOS imager. Such a device could detect track position as well as detecting and recognizing symbols used to initiate additional actions. Alternatively, to reduce the cost of the device, it is possible to use a simple pair of photodetectors 14 positioned on either side of the track 12 as shown in FIG. 1B for tracking purposes. These photodetectors 14 may be in the form of any photosensitive sensor. Examples of suitable photodetectors include, but are not limited to, photodiodes, photoresistors made of CdS, and phototransistors. In order to reduce costs and still detect and recognize control codes for initiating other actions in addition to tracking, additional photodetectors 14 can be provided.

Figure 1C:
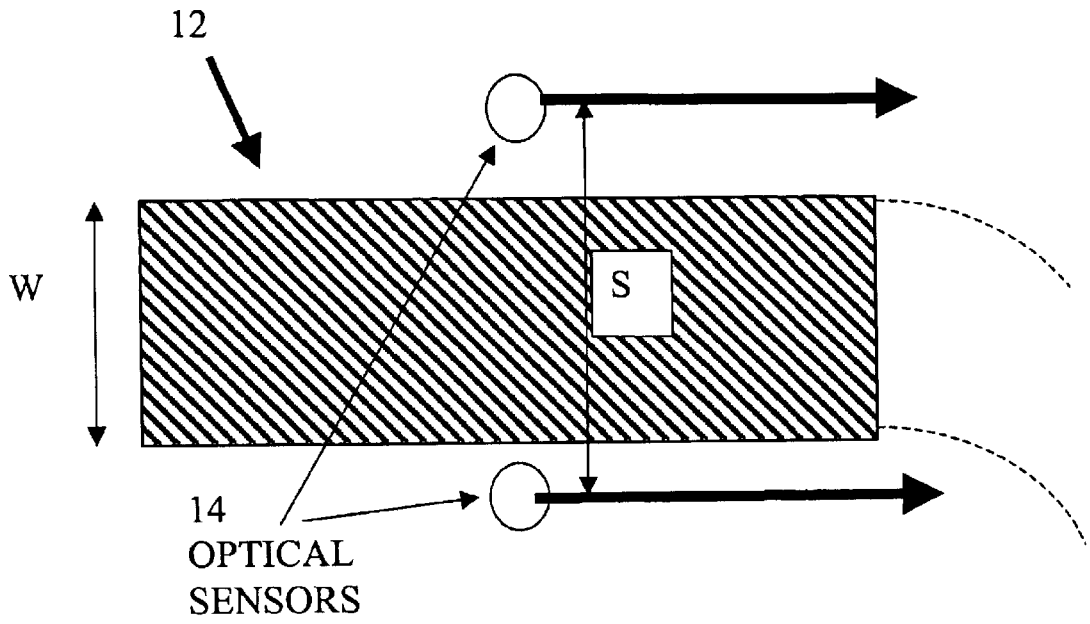
FIG. 1C is an enlargement showing the paired sensors straddling the track so as to read "white" in the normal condition.

FIG. 1C shows one preferred embodiment of the detailed location of the sensors 14 with regard to the track 12. In this figure, the sensors 14 are straddling the track 12 so as to read "white" as the normal indication. If the toy vehicle moves and the detectors read or sense black, a signal is sent to change the drive on one of the wheels. This returns the toy vehicle to the track 12 and restores the sensor to read "white" again. For example, if the track 12 is curving down as shown by the dotted line in FIG. 1C, then as the vehicle moves to the right (as shown by the horizontal arrows), the lower sensor 14 will eventually read "black". To correct this and return the vehicle to the track 12, either the lower wheel must reduce speed or the upper wheel must increase speed to cause the vehicle to turn to the right (in a downward direction on the paper). To minimize "hunting" or constant changing of the sensors 14, which can occur in all feedback systems, it is desirable to make the sensor separation. S, significantly larger than the track width. W. so that the vehicle is not constantly oscillating back and forth, correcting first one and then the other sensor position. It is also important that the track width is large enough that the sensor 14 does not pass through the black zone so quickly that there is no opportunity to correct the position to drive it back into the white area.

A key feature of any mechanical configuration that relies on changing the velocity of one of the drive wheels to accomplish turning rather than using a steering wheel driven by a motor is that the non-driven wheels must be able to either slide sideways or swivel. If each of the non-driven wheels can swivel individually, or if a single wheel that swivels is used for the rear support, then the non-driven axle is free to move sideways when the vehicle pivots around one of the driven wheels.

Figure 2:
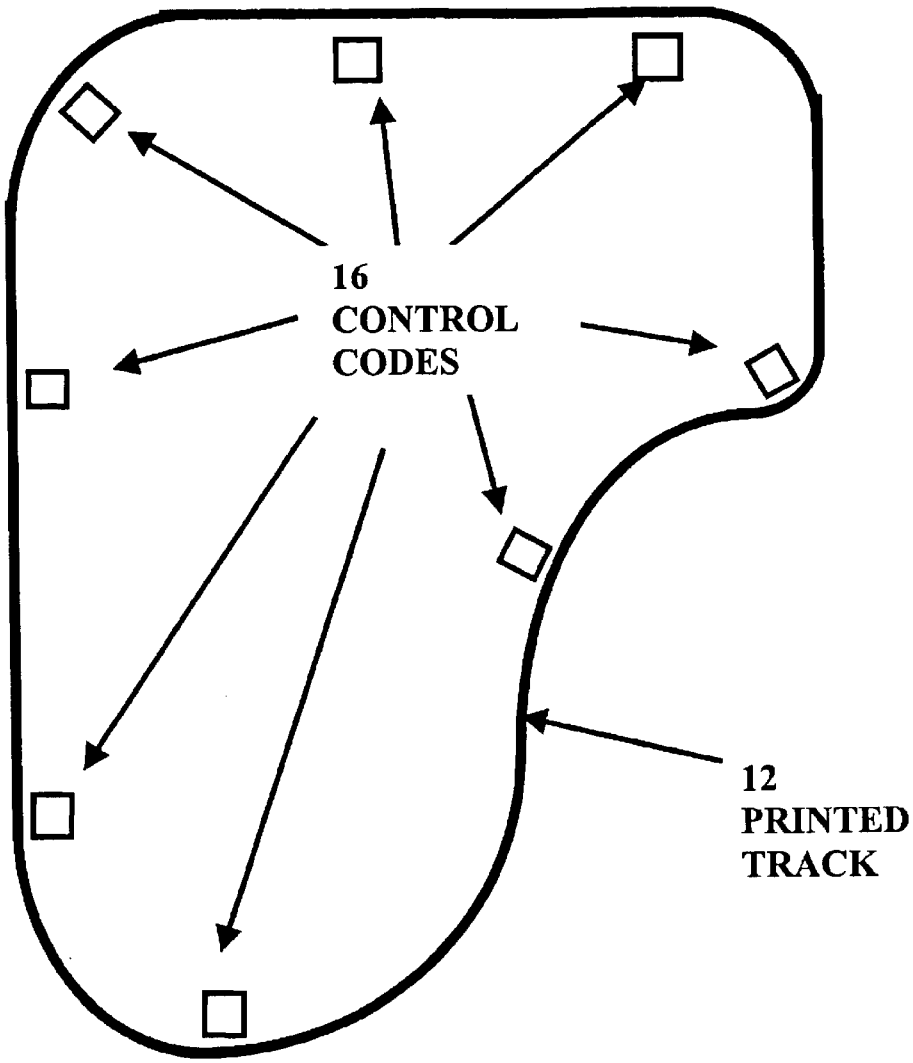
FIG. 2 depicts an example of a printed track that has printed control codes placed along the track path.

FIG. 2 shows one preferred embodiment of a printed track 12 having control codes 16 printed alongside the track. The intervals control code 16 are determined by the track-printing software as programmed by the user, and the codes 16 are printed in 8-bit code capable of encoding $2^8$ unique symbols for controlling 256 actions (such as reversing, stopping, starting, accelerating, making sounds, turning on lights, and the like) In addition to the two detectors used for tracking, the vehicle also has photodetectors that read the 8-bit code that initiates the various actions. In one preferred embodiment, the 8 printed code bits are arranged in a line perpendicular to the track 12 so that they can be read out in parallel.

Figure 3A:
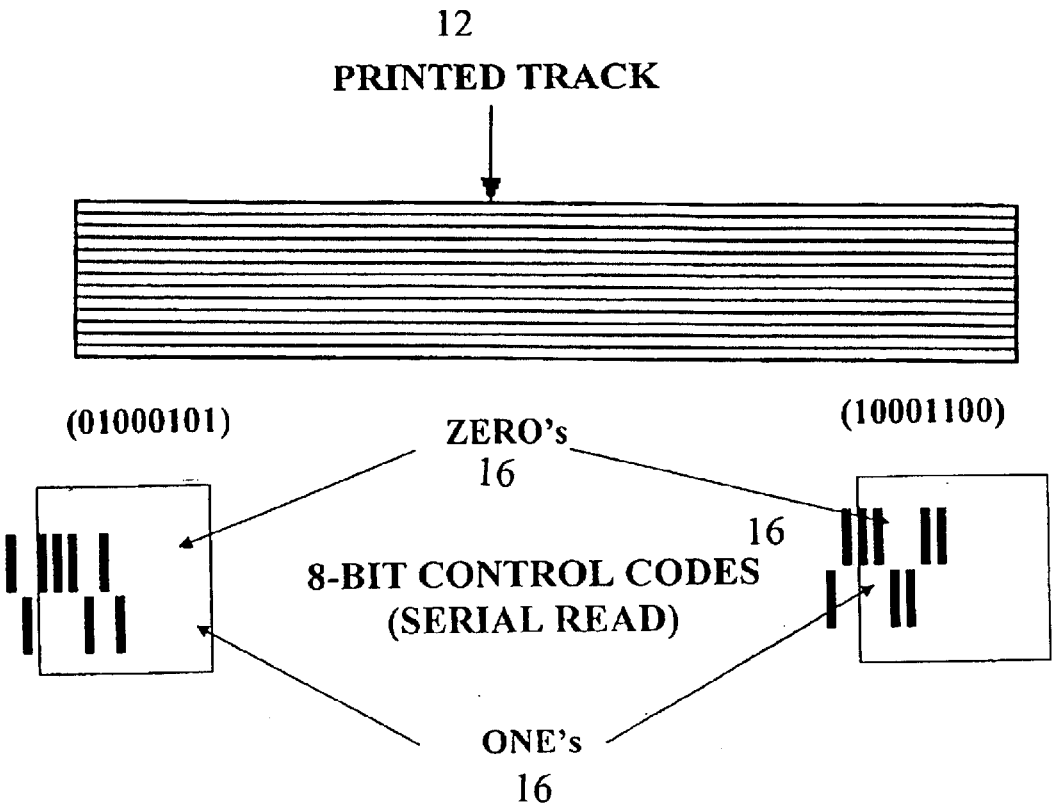
FIGS. 3A and 3B depict examples of 8-bit printed control codes that are read out serially a bit at a time.

In a more economical version, the 8 bit positions are located along a line parallel to the track 12 in a form similar to a bar code and read out serially by a pair of sensors. One of the sensors 16 detects "ONE" bars, and the other sensor 14 detects "ZERO" bars, as shown in FIG. 3A. Even with this small number of bits, the large number of unique codes available would allow the encoding of something as sophisticated as individual musical notes to program the vehicle to play simple melodies as it proceeds along the track 12.

Figure 3B:
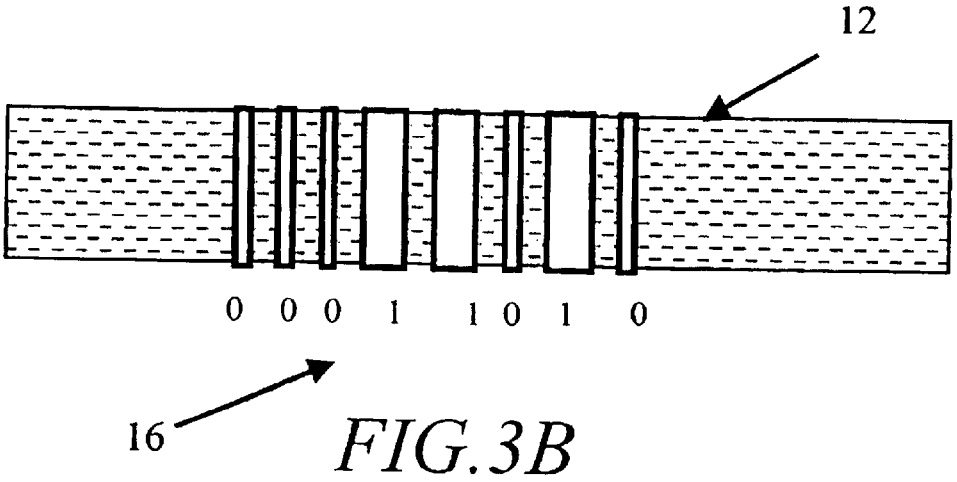

FIG. 3B depicts another preferred embodiment where the control codes 16 are a series of white spaces printed inside the track 12. As long as these white spaces are restricted to straight sections of track 12, the presence of the code will not interfere with turn control. Therefore, there is no need to print the codes at the side of the track 12. In this embodiment, a single extra sensor will pick up either a narrow white stripe or a wide white stripe corresponding to the "ZERO" and "ONE" bits of the code respectively.

Figure 4:
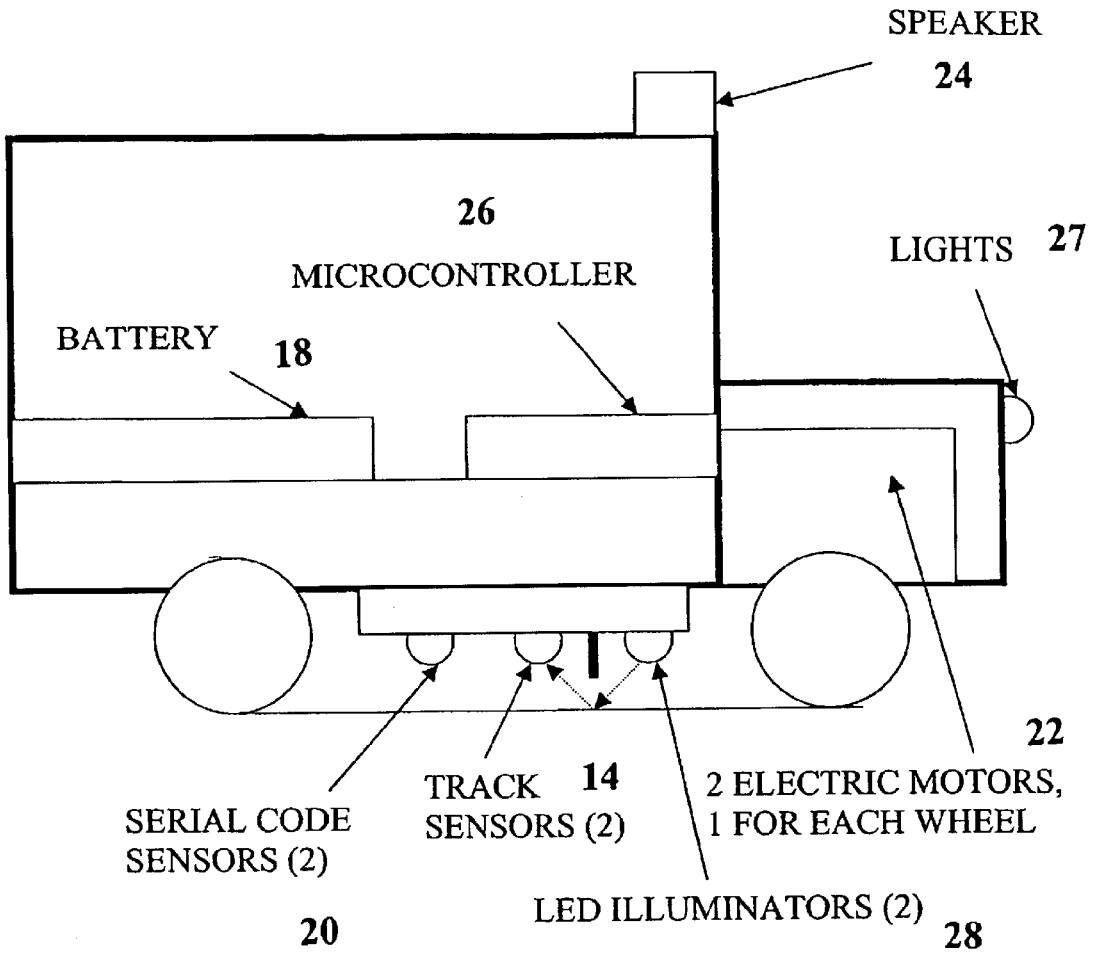
FIG. 4 depicts a side view of a preferred embodiment of a toy track vehicle showing the components built into the vehicle to perform the necessary functions of tracking and code recognition.

FIG. 4 shows the components required to perform tracking, decoding of control codes and providing inputs to the motor, sound and other actuators These components include a power source 18, such as a 9 volt battery, the photosensors 14 for tracking and detection of control codes 20, the motors 22 for independent drive of two wheels, a speaker 24 for sound generation, lights 27 and a microcontroller 26. Examples of microcontrollers suitable for controlling actuators include those manufactured by ZILOG and MICROCHIP. For simple tracking alone, the microcontroller 26 is not necessary, as explained in greater detail below.

FIG. 4 shows one embodiment of built-in illuminators 28, such as LEDs, that can be the source of light that supplies the optical signal resulting from reflections from the track and surrounding white background. Alternatively, ambient room light may be used instead Using built-in illuminators 28 has the advantage of a concentrated, controllable light source but requires battery power to operate. Ambient light uses no battery power but is less powerful and more variable. In order to cut down on illuminator power, the light from the LED tracking illuminators can be used to supply enough spillover light to allow control code detection.

Figure 5:
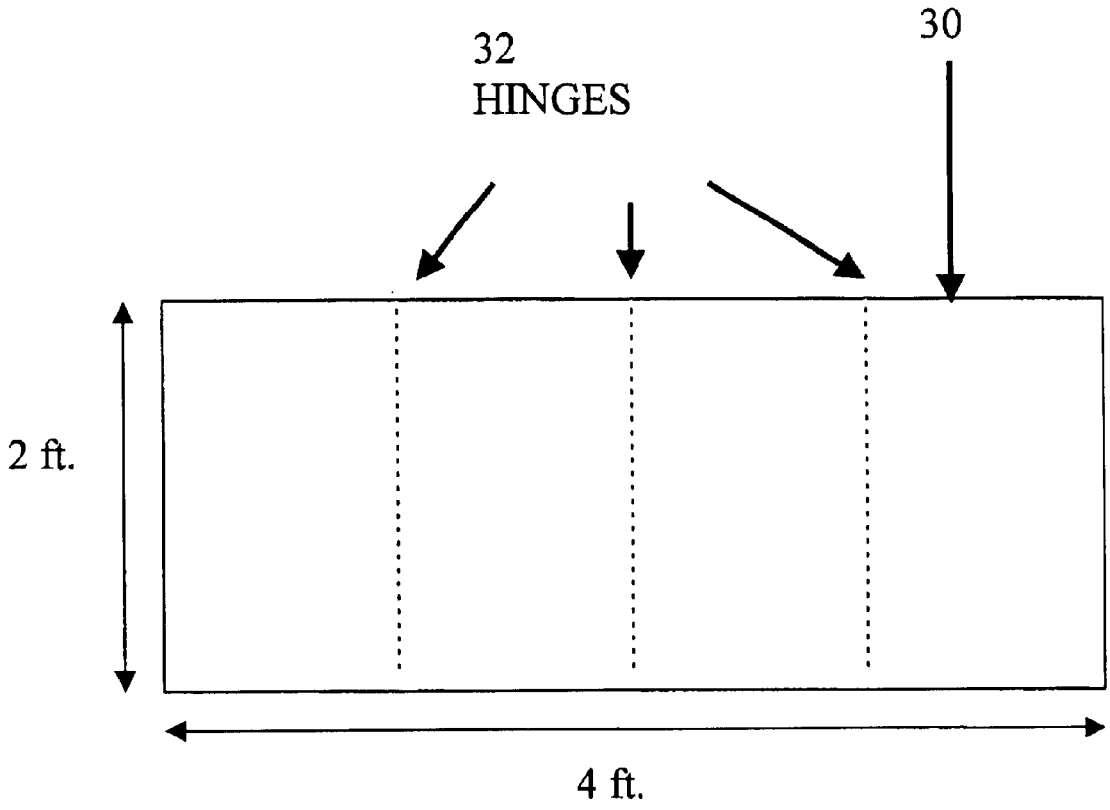
FIG. 5 depicts an example folding game board that can be used as a surface for assembling groups of track sheets to form a much larger track area.

In one preferred embodiment of this invention, a computer is used to print out the track. It is preferable to provide a mechanism for building tracks that are much larger than the area of a standard sheet of paper (approximately 8½×11 inches) so that the vehicle has adequate room to travel and more turns can be used. One method of accomplishing this would be to use a foldable game board, such as the board used in Monopoly® and other board games. These game boards are typically made using rigid cardboard approximately 1×2 feet and hinged in the middle to form a 2×2 foot square FIG. 5 shows an example of two of these game boards connected or hinged together to provide a 2×4 foot board 30. In the example shown, 3 hinges 32 are used. The resulting board 30 can be folded and stored in the space occupied by a conventional board game.

Figure 6A:
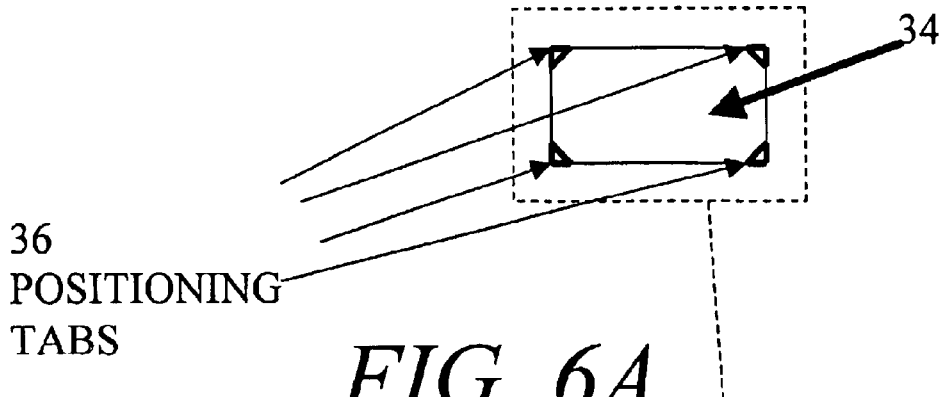
FIG. 6A depicts an enlargement of a single sheet of FIG. 6 fixed in place by the use of corner tabs.
Figure 6:
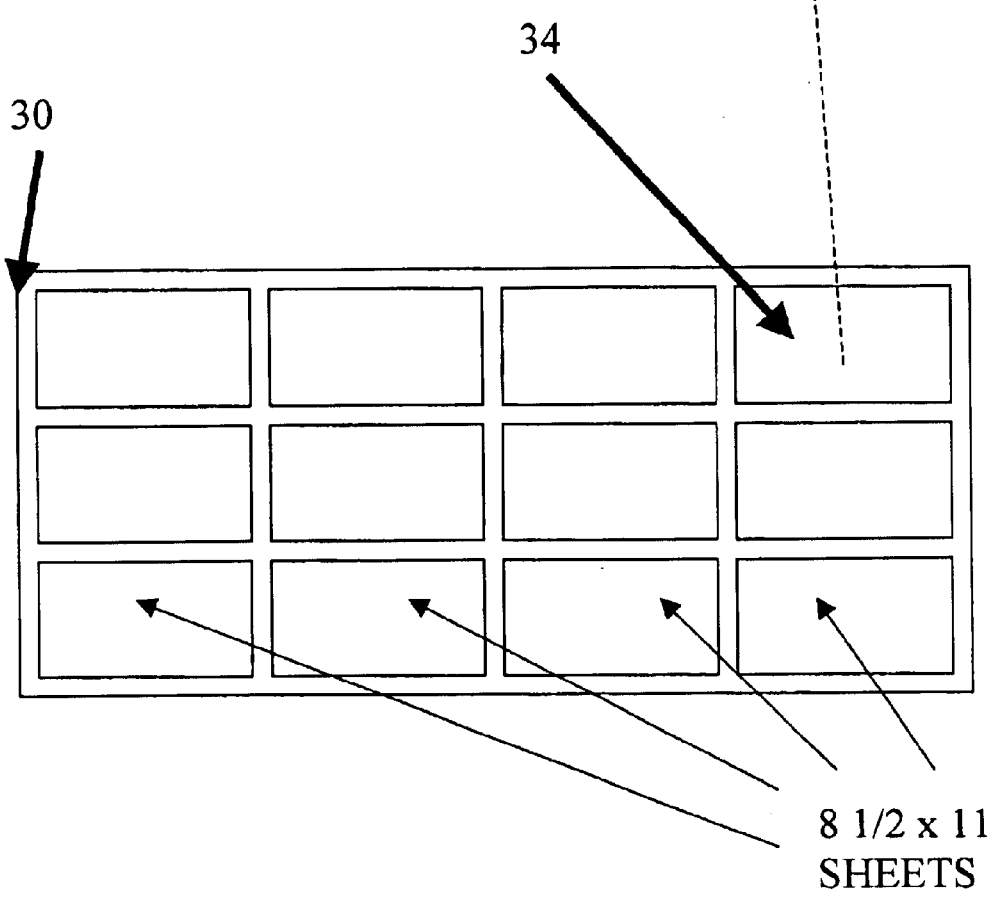
FIG. 6 depicts an assembly of 8 track sheets to form an approximately 2 foot by 4 foot track area.

FIG. 6 shows how a 2×4 foot game board 30 could be filled with 8 sheets of 8½×11 inch paper 34. In order to expedite the layout of these smaller sheets of paper 34, alignment ridges or catches 36 (such as those used in photograph albums or on desk blotters) can be placed at the corners of each sheet 34 so as to position them accurately and simply, as shown in FIG. 6A. This task can be easily performed with a minimum of dexterity required A major feature of the computer-generated track is that a sophisticated software program can provide a user-friendly layout mechanism for piecing together track sections, automatically avoiding turns that are too tight and keeping the tracks away from corner tabs. This will guarantee that when the vehicle is crossing boundaries between sheets, track sections are straight, providing a number of predesigned default track configurations that can then be added to or otherwise modified. Furthermore the software would allow different people to trade designs and form clubs for building bigger and more interesting designs.

An important issue with regard to composing a large track from a set of 8½×11 sheets is the crossover between sheet boundaries because printers do not generally print to the edges of the paper, and there is often misalignment between images printed on separate sheets. One way to handle this is with an arrangement similar to that shown in FIG. 1C. In FIG. 1C, the normally "white" sensor signal is present where the page is blank, making sure that the vehicle continues in an essentially straight line absent a printed track 12. As long as any misalignment between adjacent sheets is small compared to the track width, the car should continue to move across the gap in a straight line and still be able to track properly. For example, a track ½ inch wide or greater should handle sheet-to-sheet transitions without any difficulty.

In another embodiment, the track is hand-drawn by the user or another. A plastic sheet or other erasable surface, such as a dry erase board, is preferably used as the substrate for a track drawn by the user. A pen, such as a wide-trace magic marker type pen, is used, preferably of a dark color such as navy or black for better contrast to the substrate. Preprinted or hand drawn code markers are then placed by the user along the track in order to initiate vehicle actions such as turning on lights, sound, stopping and the like. The placement of these code markers would be governed by a simple set of rules to insure correct distance and orientation with respect to the track. These rules would be explained in the instructions accompanying the vehicle.

EXAMPLES

A black track approximately ½ inch wide was printed out on computer paper. A small car was built using two LEGO motors mounted side by side. Each motor drove one rear wheel. The two back wheels were mounted on independent axles. A phototransistor (PT) (Radio Shack model 276-145A) was mounted on the underside of the chassis about 2 inches ahead of the rear driven wheels. Next to the PT was an LED (Radio Shack model 276-026A) that would shine down on the paper on which the wheeled vehicle was place. The side of the PT case was wrapped in tape so that the only light from the LED that impinged on the PT was the light which was reflected off the paper surface. A second PT/LED pair was mounted on the chassis underside so that the emitter-sensor pairs were on opposite sides of the black track (as shown in FIGS. 1B and 1C). The LEDs were each connected in series with a 1 kilohm resistor operating with a supply voltage that was varied between 6 and 9 volts. This resulted in a diode current of approximately 6 and 9 mA respectively. The phototransistors were each in series with a 1 Megohm resistor as shown in FIG. 7.

Figure 7:
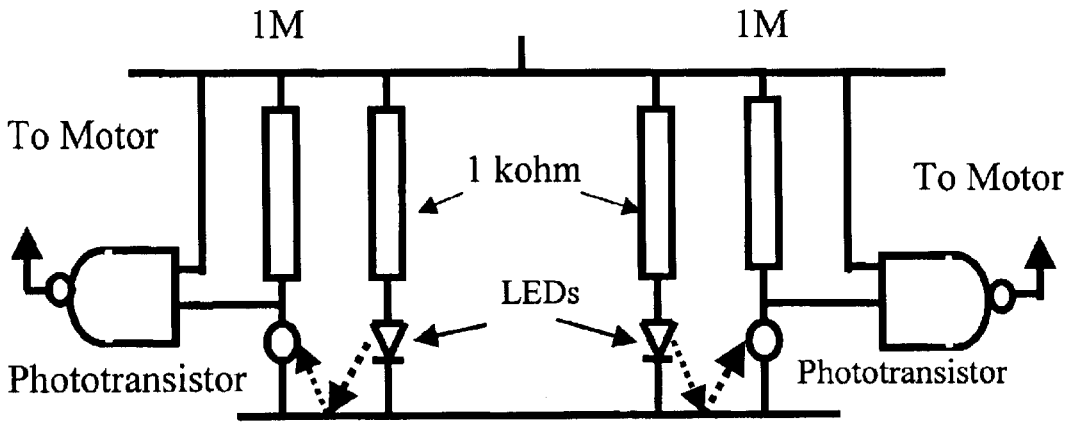
FIG. 7 depicts a sample control scheme for a toy track vehicle.

The output of each phototransistor was connected to the input of a two-input NAND gate as shown in FIG. 7. During normal on-track operation, both photosensors saw "white", since they were on either side of the track. The output of the phototransistor was close to ground. This caused the output of the NAND gate to go high, which supplied voltage to the motor and caused it to turn. When either of the two photosensors saw "black" as the printed track began to curve and the sensor detected the track, the output of that photosensor went high and caused the output of the motor to go low. This removed voltage from the motor on the corresponding side and caused it to stop, thereby causing the vehicle to pivot around the stopped wheel and to move in such a direction as to bring the photosensors back to a tracking condition. Once back in the tracking condition, the photosensors again straddle the track and both see "white". The NAND gate operates here as both a comparator and an inverter, that is, the NAND gate senses whether the phototransistor voltage is above the threshold for switching the digital NAND gate and then inverts the output so that a low input produces a high output, and vice versa.

Figure 8:
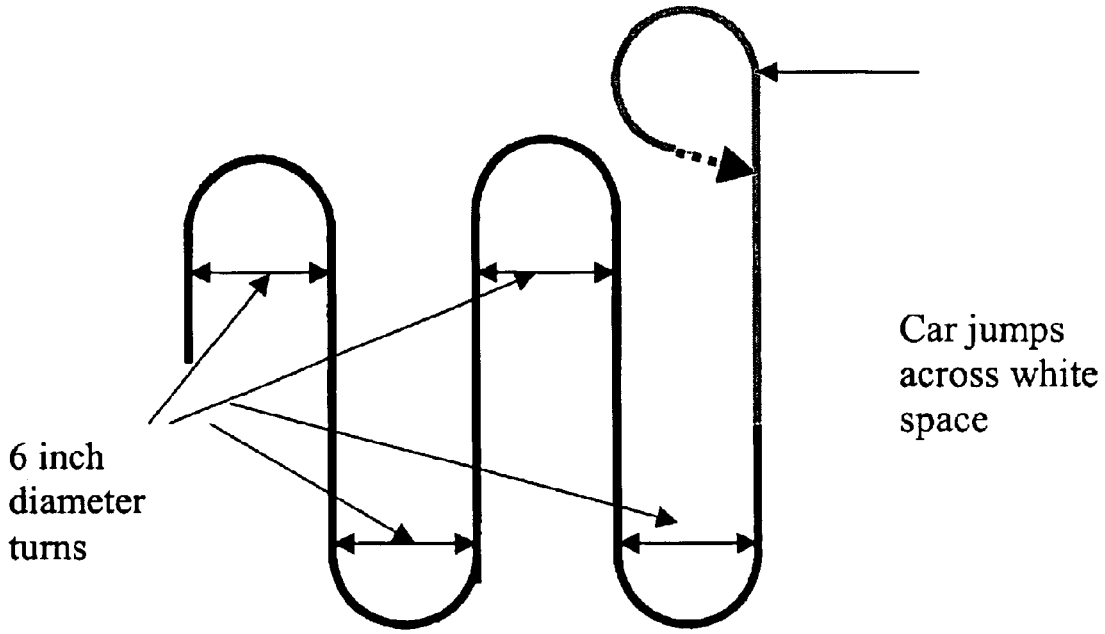
FIG. 8 depicts an example of a printed track having hairpin turns.

The vehicle was then placed on a hairpin track shown in FIG. 8. The hairpin turns were negotiated without difficulty with both a 6 volt and 9 volt supply. A straight track was then added to the hairpin track and connected to a 6 inch circular track with 90 degrees of the track covered by white paper. This produced a 270 degree turnaround as shown in gray at the right hand end of the hairpin turn. The vehicle successfully traversed the hairpin turn, went 270 degrees around the circle and then went straight ahead over the white space as shown by the arrows until it encountered the straightaway attached to the circle. It then continued along the return route along the hairpin track. This demonstrated the capability to drive "off-road" or off the track and resume tracking when it encountered the track again.

There are inherent limitations to the vehicle's ability to "retrack". If the vehicle encounters the track at large angles, such as right angles or larger (90 degrees or more), it cannot turn. But, if the vehicle encounters the track at an angle of about 60 degrees or less, it has no trouble retracking.

The experimental vehicle used rubber tires on the motor-driven wheels and plastic tires on the non-driven wheels. This allowed the non-driven wheels to slide sideways when the vehicle was turning.

Finally, in order to determine a minimum turning radius, a small, approximately 4-inch track was printed. The vehicle successfully traversed this track. Therefore, even a small turning radius can be successfully maneuvered with the vehicle and method of the present invention.

As will be apparent to persons skilled in the art, various modifications and adaptations of the structure above described will become readily apparent without departure from the spirit and scope of the invention, the scope of which is described in the appended claims.

Having described the invention, we now claim:

1. A toy vehicle for use on a printed track, said vehicle comprising:

at least two optical sensors for sensing a track position;

at least two wheels driven by at least one motor, whereby the at least one motor controls the wheel speed; and a light source for illuminating the printed track, whereby the at least two optical sensors maintain the vehicle in position over the printed track as it moves along the track, and wherein the vehicle is not secured to the track, and wherein the sensors are positioned with respect to the printed track such that one signal is picked up when the vehicle is on track, and a different signal is picked up when the vehicle is moving off the track.

2. A method for controlling a toy vehicle on a printed track, wherein the toy vehicle has at least two driven wheels, said method comprising the steps of:

obtaining a printed track for the vehicle, said track comprising a printed track pattern and control codes for controlling actions of the vehicle, wherein the control codes initiate actions including starting, stopping, reversing, accelerating, slowing, turning, leaving the track, making noise, turning on lights, and combinations thereof;

placing the vehicle on the printed track;

controlling the toy vehicle by sensing the position of the vehicle on and off the printed track, and;

automatically changing the position of the vehicle using the driven wheels to return the vehicle to the track when the vehicle moves away from the track, and wherein the vehicle is not secured to the track.

3. The toy vehicle of claim 1, wherein the light source is selected from the group consisting of LED and ambient light.

4. The toy vehicle of claim 1, wherein the optical sensor is selected from the group consisting of phototransistors, CCD or CMOS.

5. The toy vehicle of claim 1, wherein each wheel is separately driven by a motor.

6. The toy vehicle of claim 1, further comprising a microcontroller for controlling the vehicle.

7. The method of claim 2, wherein the track is printed on paper.

8. The method of claim 2, wherein the track is created by a computer and printer.

9. The method of claim 2, wherein the step of controlling the toy vehicle by sensing the position of the vehicle on and off the printed track includes a normal position of white and an off truck position as black.

10. The method of claim 2, wherein the step of controlling the toy vehicle by sensing the position of the vehicle on and off the printed track includes a normal position of black and an off track position as white.

11. The method of claim 2, wherein the printed track can be folded for storage.

12. The method of claim 2, wherein the control codes are printed beside the track.

13. The method of claim 2, wherein the control codes are printed on the track.

* * * * *